United States Patent [19]

Atack et al.

[11] 4,035,844

[45] July 19, 1977

[54] NOVEL TROUSER-LIKE ARTICLE OF CLOTHING

[76] Inventors: James W. Atack, 4230 Patten Cresent; Howie Triano, 6776 McMicking Street; Peter Zoretich, 6711 McMicking Street, all of Niagara Falls, Ontario, Canada

[21] Appl. No.: 197,311

[22] Filed: Nov. 10, 1971

[30] Foreign Application Priority Data

Apr. 27, 1971 Canada ..... 111457

[51] Int. Cl.[2] ..... A41D 13/00

[52] U.S. Cl. ..... 2/2; 2/22; 2/DIG. 1; 2/227; 2/404; 128/159

[58] Field of Search ..... 2/227, 224 R, 224 A, 2/232, 232 A, 24, 23, 22, 237, DIG. 1, 247, 250, 404, 2; 128/132, 159, 161

[56] References Cited

U.S. PATENT DOCUMENTS

| | | | |
|---|---|---|---|
| 173,306 | 2/1876 | Laskey | 2/237 |
| 1,255,820 | 2/1918 | Oppenheim | 128/159 |
| 1,784,285 | 12/1930 | Heaton | 2/232 X |
| 1,830,351 | 11/1931 | Dorais | 2/24 |
| 3,059,638 | 10/1962 | Savage | 128/159 |
| 3,168,746 | 2/1965 | Smith | 2/24 |
| 3,170,163 | 2/1965 | Mitchell | 2/2 |
| 3,176,686 | 4/1965 | Barnes | 2/2 X |
| 3,376,864 | 4/1968 | Gulack | 128/161 |
| 3,566,624 | 3/1971 | Burleson | 2/224 R X |
| 3,670,339 | 6/1972 | Cooper | 2/24 |
| 3,787,892 | 1/1974 | Quinn | 2/22 |
| 3,788,314 | 1/1974 | Noreen | 128/159 |

FOREIGN PATENT DOCUMENTS

| | | | |
|---|---|---|---|
| 1,332,108 | 4/1963 | France | 2/232 |

*Primary Examiner*—H. Hampton Hunter
*Attorney, Agent, or Firm*—Arthur A. March

[57] ABSTRACT

A novel trouser-like article of clothing is provided which combines the functions of underwear, socks, garter belts and crotch protector, while providing an attractive, light-weight and durable garment which may be worn under conventional sporting clothing, e.g. hockey pants.

19 Claims, 9 Drawing Figures

Fig. 1.
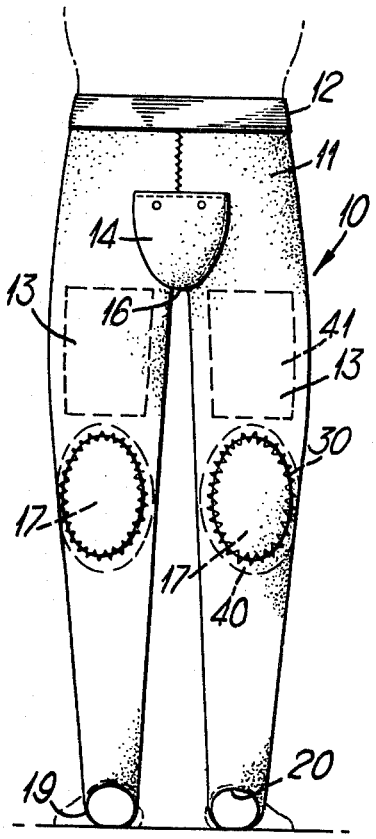
Fig. 2.
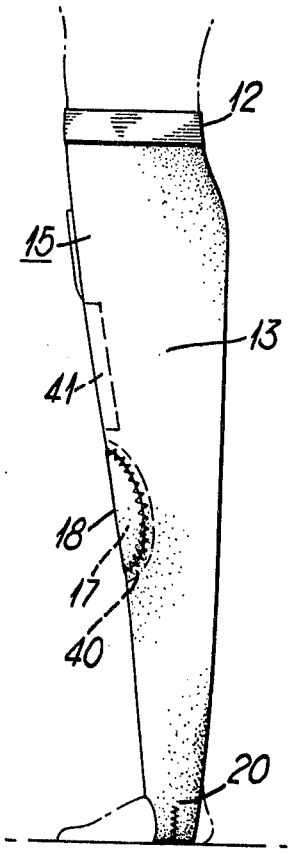
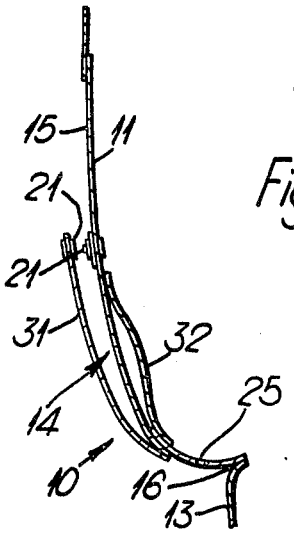
Fig. 3.
INVENTOR
BY
ATTORNEY

INVENTOR

BY

ATTORNEY

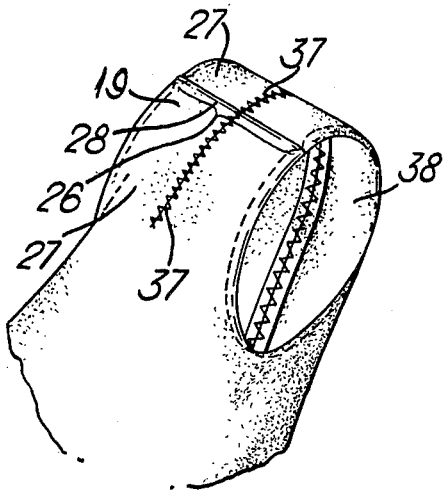
Fig. 7.
Fig. 8.
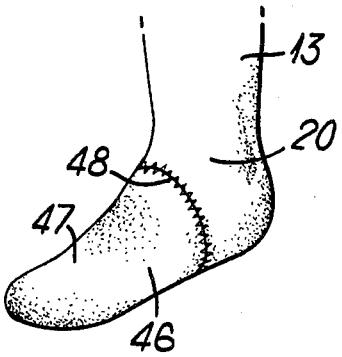
Fig. 9.
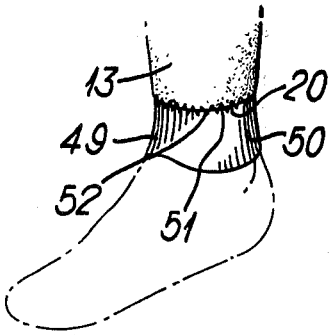
INVENTOR
BY
ATTORNEY

NOVEL TROUSER-LIKE ARTICLE OF CLOTHING

BACKGROUND OF THE INVENTION

1. FIELD OF THE INVENTION

This invention relates to an article of clothing, and particularly one that is adapted to be worn while partaking in wintertime athletic endeavours. More specifically, it relates to under-trousers adapted to be worn by hockey players underneath the conventional hockey pants.

2. DESCRIPTION OF THE PRIOR ART

Many proposals have been made to provide improved external articles of clothing by providing such features as reinforcing knee patches, ventilated areas at the crotch, armpits and neck, elastic bands to maintain the legs of pants in close proximity to the foot of the wearer, providing adjustable pouches within trousers, and providing clothing made of stretchable material. Nevertheless, in many winter sports, underclothing is worn which consists of a plurality of different conventional clothing articles. In one instance, that of hockey players, separate and distinct hockey socks, garter belts, extra undergarments, and a crotch protector must be worn in addition to the hockey pants. The provision of a single article of clothing to satisfy these many wants is a problem which has been left virtually alone and unsolved.

NATURE OF THE INVENTION a. AIMS OF THE INVENTION

Thus, an object of a principal aspect of this invention is the provision of a single garment which substantially eliminates the need for the above-described plurality of separate garments.

b. BROAD STATEMENT OF THE INVENTION

By a broad aspect of this invention, there is now provided in a trouser-like article of clothing formed of a material which is elastically stretchable both in the longitudinal and transverse directions, the provision of an external, frontal, reclosable crotch pocket, adapted, at the will of the wearer, to retain a crotch protector pad therein.

c. VARIANTS OF THE INVENTION

In other aspects of this invention, one or all of the following additional features are provided:

a. an internal crotch pocket to co-operate with the external crotch pocket;

b. means adapted to retain the trouser-like garmentin position when worn, e.g. an attached encircling belt of elastic material, or a draw string, or any other alternative equivalent means;

c. an insert disposed at the juncture of the legs and the crotch, the insert being provided with ventilation apertures;

d. a reinforcing and protective patch at each knee;

e. means at the bottom of the leg to help maintain the bottom of the leg of the trouser-like garment at the ankle of the wearer of the trouser-like garment, for example (i) a band-like extension at the bottom of each leg, the extension extending at least across the instep portion of a foot of the wearer of the garment, (ii) extensions of the bottom of the leg to provide a full stocking-like foot enclosure, or (iii) a band of an elastic material at the bottom of the leg adapted to embrace the ankle of the wearer of the garment;

f. a pocket in the thigh area and/or an additional pocket at the knee for the possible inclusion of padding.

DESCRIPTION OF THE INVENTION a. BRIEF DESCRIPTION OF THE DRAWINGS

In the accompanying drawings,

FIG. 1 is a front elevation of the trouser-like undergarment of an embodiment of this invention, as worn;

FIG. 2 is a side elevational view of the undergarment of FIG. 1;

FIG. 3 is a cross-sectional detail showing the external crotch pocket and the co-operating internal crotch pocket of the garment of FIGS. 1 and 2;

FIG. 7 is a detail, in perspective form, showing one embodiment of means to retain the bottom of the leg in position, namely a band-like extension at the bottom of the leg of the garment of FIGS. 1 and 2;

FIG. 8 is a detail, in perspective form, showing another embodiment of means to retain the bottom of the leg in position, namely an internal, stocking-like enclosure; and FIG. 9 is a detail, in perspective form, showing yet another embodiment of means to retain the bottom of the leg in position, namely an ankle embracing elastic material band.

b. DESCRIPTION OF FIGS. 1 AND 2

Figure 4:
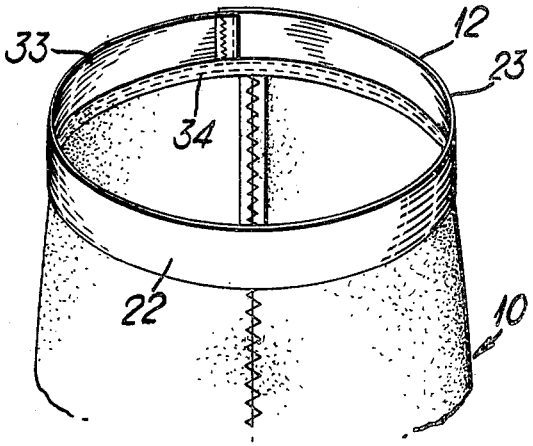
FIG. 4 is a perspective detail showing one embodiment of a trouser-like retaining waist band, namely the elastic material belt band of the garment of FIGS. 1 and 2.

As seen generally in FIGS. 1 and 2, the trouser-like undergarment 10 includes a main body portion 11 including a waist 12 and a pair of legs 13. The undergarment may be made out of wool, cotton, nylon, dacron, rayon or any other synthetic fabric or any combination of natural and synthetic fabrics. The threads used for the fabrics may be non-elastic, elastic or a combination of both. The undergarment is designed snugly to fit the contours of the body of the wearer. The undergarment is preferably coloured, and the colour patterns include solids, stripes, or any combination of these for aesthetic appearance. An external crotch pocket 14 is provided at the frontal area 15 above the junction 16 of the legs 13 with the body portion 11.

A reinforcing and protective knee patch 17 is provided at the knee 18 of each leg 13 stitched on by stitching 30. In addition, auxiliary pockets 40, 41 are provided at the knees and thighs respectively, for the insertion of padding, if desired. Finally, in the particular embodiment shown in FIGS. 1, 2 and 4, a foot band 19 is provided at the bottom of each leg 13.

As also seen in FIGS. 1 and 2, the protective circular or oval knee patch 17 is sewn onto the knee 18 by stitching 30 in such a way that the bias of the stretchable material of the patch is at a maximum angle to the bias of the material at the knee. It is contemplated that, in addition to being reinforcement for the knee, the patch 17 may be provided internally with protective material in the form of bendable, strong material (not shown). Furthermore, the additional knee pocket 40 is stitched only on three sides with the top open to permit the insertion of padding, if desired. Similarly, the additional thigh pockets 41 are stitched only on three sides, with the top open to permit the insertion of padding, if desired.

c. DETAILED DESCRIPTION OF FIG. 3

As seen in FIG. 3, the crotch pocket 14 includes a piece of material 31 sewn externally onto the body 11 at the frontal area 15 above the junction 16 of the legs 13. The pocket 14 is generally pouch-shaped and is provided wih a plurality of snap-fasteners 21 to enable access to the inside of the pocket 14 while permitting closure thereof at will when the crotch protecting cup (not shown) is in place. Other releasably engageable closure means may, of course, by used, e.g. the reclosable fasteners known as "zippers" and the interengageable fasteners known by the Trade Mark of "Velcro". On the interior of the undergarment 10 is sewn a cooperating supporting pocket 32 of stretchable material.

d. DETAILED DESCRIPTION OF FIG. 4

As seen in FIG. 4, the belt band 22 is a band of elastic material, formed of a plurality of elastic bands 33 in which the stretchability is along the periphery 23 of the waist 12. The band 22 is sewn, by stitching 34 to the waist 12 of the undergarment 10. This enables the belt band to retain the trouser-like undergarment 10 in place when the trouser-like undergarment 10 is worn.

e. DETAILED DESCRIPTION OF FIG. 5

Figure 5:
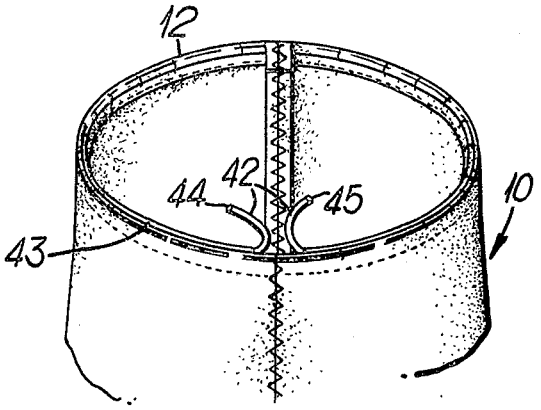
FIG. 5 is a perspective detail showing a second embodiment of a trouser retaining waist band, namely a draw string arrangement in the garment of FIGS. 1 and 2.

The embodiment shown in FIG. 5 provides a draw string 42 disposed in an encircling waist pocket 43. Drawing the ends 44, 45 of the string and tying them together enables the trouser-like undergarment to be retained in place when worn.

f. DETAILED DESCRIPTION OF FIG. 6

Figure 6:
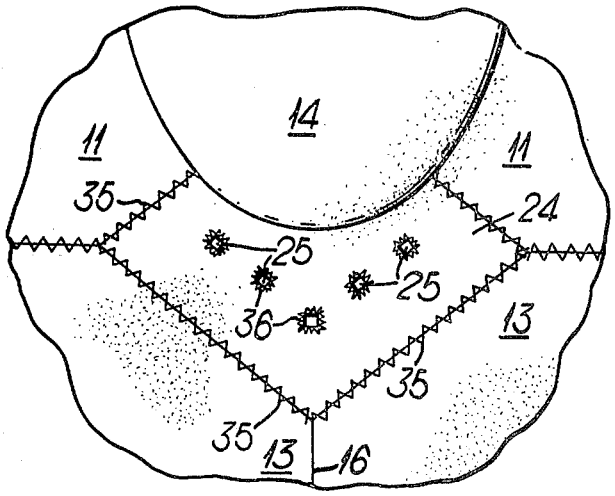
FIG. 6 is a detail, in plan form, showing the ventilation insert of this garment of FIGS. 1 and 2.

As seen in FIG. 6, the ventilation insert is a piece of material 24 sewn into place by stitching 35 at the junction 16 of the legs 13 with each other and with the body portion 11. The material 24 is provided with a plurality of vent holes 25 surrounded by stitching 36. While holes have been shown, other ventilation means of an equivalent nature, as, for example, slits, mesh, etc. may be provided.

g. DETAILED DESCRIPTION OF FIG. 7

As seen in FIG. 7, one embodiment of a lower leg retaining means is shown, namely a foot band 19, which is of a lateral width 26 so that it extends across the instep, or the bottom of the arch of the foot of the wearer. It consists of two extensions 27, sewn at 28 to provide a smooth seam. In addition, stitching 37 is used to provide the proper taper to the foot band 19. Also shown is the foot aperture 38.

h. DETAILED DESCRIPTION OF FIG. 8

FIG. 8 shows another embodiment of a lower leg retaining means, namely a stocking-like enclosure extension 46. This is provided by having the bottom of the leg 20 extended and shaped in the form of a foot 47. The two portions are stitched together at 48 to provide the stocking-like enclosure 46.

i. DETAILED DESCRIPTION OF FIG. 9

FIG. 9 shows another embodiment of a lower leg retaining means, namely an ankle embracing band 49. The band is of elastic material, formed of a plurality of elastic bands 50 in which the stretchability is along the periphery 51 of the bottom 20 of the leg 13. The band may be sewn by stitching 52 to the ankle band at the bottom 20 of the leg 13. The encircling and embracing of the ankle of the wearer of the undergarment 10 maintains the undergarment in position.

SUMMARY

It is seen that the trouser-like undergarment 10 takes the place of conventional hockey socks, and obviates the need for garter belts and additional undergarments. In addition, once a rigid crotch cup is inserted in the external crotch pocket 14, the need for a conventional crotch pouch is obviated. The means to maintain the leg of the undergarment near the foot of the wearer, e.g. the foot band, the stocking-like enclosure, or the ankle embracing elastic band maintains the bottom of the legs in proper position, and the waist retaining means, e.g. the elastic belt band or the draw string maintains the waist of the trouser-like undergarment in proper position.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably and "intended" to be, within the full range of equivalence of the following claims.

We claim:

1. In a trouser-like article of clothing formed of a material which is elastically stretchable both in the longitudinal and transverse directions, the provision of a frontal, openable and reclosable crotch pocket on the exterior surface of the trouser, adapted, at the will of the wearer, to retain a crotch protector cup therein, and means for opening and reclosing such pocket.

2. The article of clothing of claim 1 including a cooperating internal crotch pocket for a pad adjacent the external crotch pocket.

3. The article of clothing of claim 1 including means, at the waist thereof, adapted to retain the trouser-like undergarment in position when worn.

4. The article of clothing of claim 3 wherein the waist means comprises an attached encircling belt of elastic material.

5. The article of clothing of claim 3 wherein the waist means comprises a retained draw string.

6. The article of clothing of claim 1 including an insert disposed at the juncture of the legs and the crotch, said insert being provided with gas conducting permeable means.

7. The article of clothing of claim 1 including an insert disposed at the juncture of the legs and the crotch, said insert being provided with ventilation holes.

8. The article of clothing of claim 1 including a reinforcing and protective oval or round patch at each knee.

9. The article of clothing of claim 1 including pockets at the knee for the insertion of padding.

10. The article of clothing of claim 1 including means at the bottom of the legs adapted to maintain the bottom of the leg at the area of the foot of the wearer.

11. The article of clothing of claim 10 wherein the leg retaining means comprises a band-like extension at the bottom of each leg, said extension extending at least across the instep portion of a foot.

12. The article of clothing of claim 10 wherein the leg retaining means comprises a stocking-like enclosure at the bottom of the leg.

13. The article of clothing of claim 10 wherein the leg retaining means comprises an attached encircling elastic band adapted to embrace the ankle of the wearer.

14. A trouser-like article of clothing comprising a one-piece undergarment with a waist, crotch and externally exposable legs, formed of a material which is elastically stretchable both in the longitudinal and transverse directions and adapted to fit snugly the contours of the body of the wearer and having a frontal, openable and reclosable crotch pocket on the external surfaces of the trouser, in the form of a panel portion sewn externally onto the adjacent underlying portion of the material thereat and adapted, at the will of the wearer, to retain an athletic crotch protector cup therein, means for opening and reclosing such pocket, and means at the waist thereof adapted to retain the upper portion of the trouser-like undergarment in position when worn in conjunction with means at the bottom of the legs thereof adapted to maintain the bottom of the corresponding leg at the area of the foot of the wearer.

15. The article of clothing of claim 14 including a cooperating internal crotch pocket of such stretchable material for a pad adjacent the external crotch pocket.

16. The article of clothing of claim 1 including pockets at the thigh for the insertion of padding.

17. The article of clothing of claim 1 including pockets both at the knee and at the thigh for the insertion of padding.

18. In a trouser-like article of clothing formed of a material which is elastically stretchable both in the longitudinal and transverse directions, the provision of a frontal, openable and reclosable crotch pocket on the exterior surface of the trouser formed in complemental part by the adjacent underlying portion of such material thereat, and adapted, at the will of the wearer, to retain a crotch protector cup therein, and means for opening and reclosing such pocket.

19. The article of clothing of claim 18 including a cooperating internal crotch pocket for a pad adjacent the external crotch pocket.

* * * * *